United States Patent [19]

Ruuth

[11] 4,414,520

[45] Nov. 8, 1983

[54] THERMOSTAT

[76] Inventor: Jonny Ruuth, Postlada 9138, S-951 90 Luleå, Sweden

[21] Appl. No.: 359,663

[22] PCT Filed: Jun. 26, 1981

[86] PCT No.: PCT/SE81/00188

§ 371 Date: Mar. 1, 1982

§ 102(e) Date: Mar. 1, 1982

[87] PCT Pub. No.: WO82/00219

PCT Pub. Date: Jan. 21, 1982

[30] Foreign Application Priority Data

Jul. 4, 1980 [SE] Sweden ..... 8004951

[51] Int. Cl.[3] ..... H01H 61/013

[52] U.S. Cl. ..... 335/208; 335/146

[58] Field of Search ..... 335/208, 146, 217; 200/67 D

[56] References Cited

U.S. PATENT DOCUMENTS 2,537,682 1/1951 Ljungfeldt ..... 200/67 D 3,760,310 9/1973 Carson ..... 335/208

*Primary Examiner*—Harold Broome

*Attorney, Agent, or Firm*—McGlew and Tuttle

[57] ABSTRACT

Thermostat comprises a heat sensitive body of ferromagnetic material and a movable magnet cooperating therewith. A pair of a contacts which are closed or open depending upon the position of the magnet are provided where the position in turn depends upon the temperature dependant magnetic properties of the sensitive body. The magnet is exposed to a counter force, that is oppositely directed to the attraction force, and a spring force on a pair of contacts has a contact making action in one position of the magnet and a contact opening action in another position of the magnet. More particularly the counter force and the spring force are exerted by one and the same snap spring, that acts between the movable contact formed as a contact tongue and the magnet.

9 Claims, 6 Drawing Figures

THERMOSTAT

FIELD AND BACKGROUND OF THE INVENTION

The present invention relates in general to thermostats and in particular to a new and useful thermostat utilizing a magnet.

Thermostats are known which have a heat sensitive body of ferromagnetic material and a movable magnet cooperating therewith. Biasing means are provided which act between a movable first contact designed as a contact tongue and the magnet. The spring means are arranged to exert a force on the contact tongue with a contact making action against a second contact in one position of the magnet, and a contact opening action away from the second contact in another position of the magnet.

Due to an aspiration towards a safe and reliable contact, such thermostats have a tendency to become complicated and thereby expensive, delicate and/or space requiring structure.

The object of the invention is to provide a thermostat of the kind indicated by way of introduction, which is characterized by a very simple and thereby cheap, reliable and compact structure, while maintaining a very safe and reliable capacity for contact making.

SUMMARY OF THE INVENTION

The object of the invention is achieved by providing the thermostat with a spring tongue acting as the spring means which, in a bent condition, is biased between the contact tongue, near a contact portion thereof, and the magnet.

Accordingly, another object of the invention is to provide a thermostat which comprises a housing, a heat sensitive body of ferromagnetic material connected to the housing and having reduced magnetic attraction with increased temperature, magnet means including a permanent magnet movably mounted to the housing from an attracted position with respect to the body to a spaced position with respect to the body, the magnet means including an outwardly extending level element, a fixed contact connected to the housing, a movable contact movably mounted to the housing and biasing means engaged between the movable contact and the lever element for biasing the magnet means toward its spaced position with respect to the body, the biasing means connected to the movable contact to bias the movable contact against the fixed contact with the magnet means in its attracted position, and to bias the movable contact away with the magnet means in its spaced position.

The invention and its advantages will now be described with reference to the attached drawings.

DESCRIPTION OF THE PREFERRED EMBODIMENTS

Figure 1:
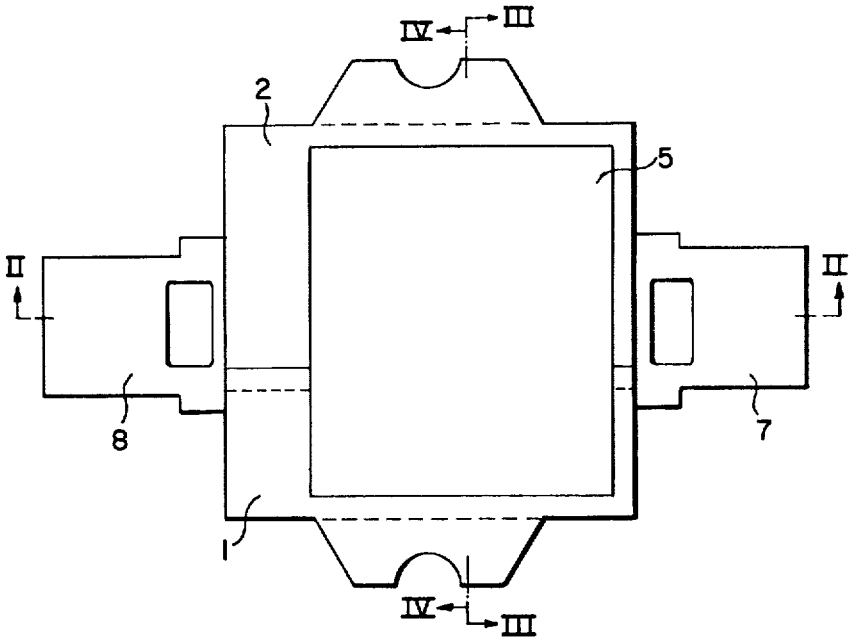
FIG. 1 is a top plan view of one embodiment of the thermostat in accordance with the invention.

The thermostat has a two part housing 1, 2. The housing contains a magnet holder 3 with a magnet 4. A wall of the housing contains a plate 5 of ferromagnetic material, which at a certain temperature, the so called Curie point, loses its magnetic properties. The housing further contains a movable contact tongue 6 with terminal tags 7 and 8 extending into the housing. The terminal tag 8 is connected to the contact tongue 6 and the portion of the terminal tag 7 located in the housing forms a contact cooperating with the contact tongue 6.

Figure 5A:
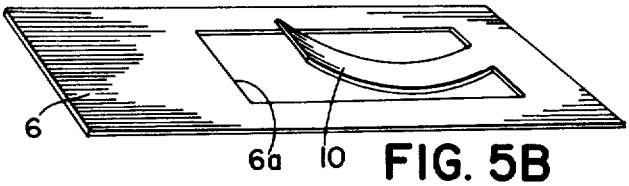
FIG. 5A is a perspective view of the movable contact tongue with biasing spring according to one embodiment of the invention.
Figure 5B:
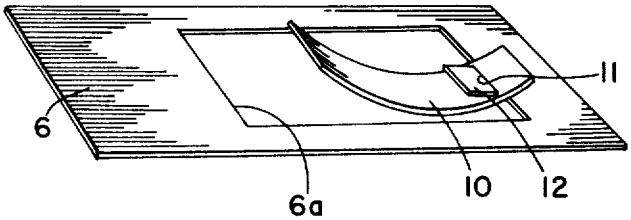
FIG. 5B is a view similar to FIG. 5A of another embodiment of the invention.

Between a pin 9, extending downwardly from the magnet holder 3 through an opening **6*a* in the contact tongue, and the contact tongue 6 a snap spring 10 is biased. With reference to FIGS. 5A and 5B the snap spring can either form part of the contact tongue or projection 6 or be a separate spring. In the latter case the spring 10 contains a slit 11, that receives a tongue 12 integral with the contact tongue 6**.

The end of the snap spring 10 most remote from the rest of contact tongue 6 is biased against the pin 9 so that thereby a pointed edge of the magnet holder 3 is kept pressed into an inner edge of the housing at 13. Thereby the magnet holder 3 will be pivotable around an axis extending through 13 perpendicularly to the plane of FIG. 1. The pivoting movement of the magnet holder 3 is limited upwardly by the sensing body 5 and downwardly by an inner projection 14 in the housing.

Figure 2:
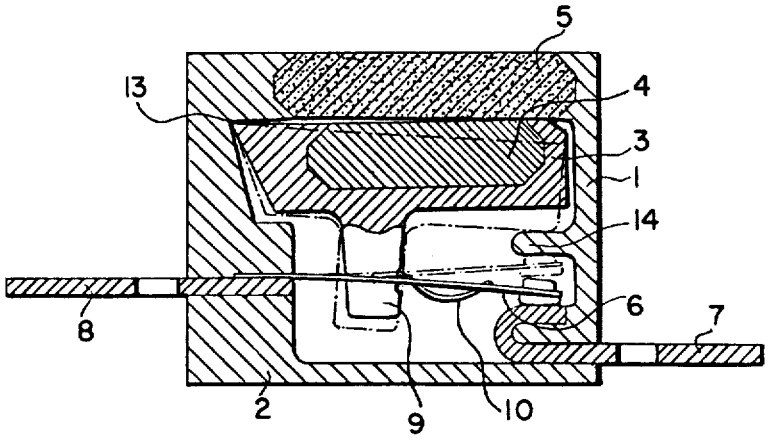
FIG. 2 is a side sectional view of the embodiment of FIG. 1 taken along line II—II of FIG. 1.
Figure 3:
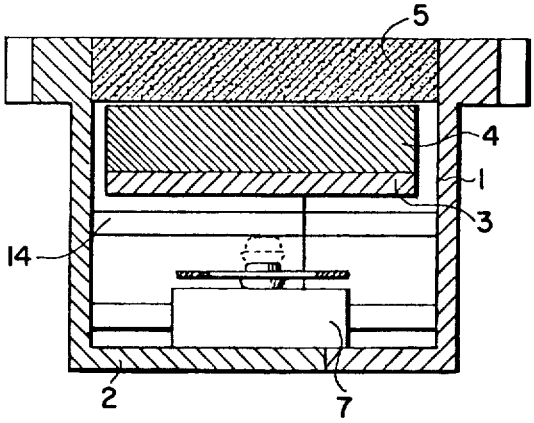
FIG. 3 is a front sectional view of the embodiment of FIG. 1 taken along the line III—III.
Figure 4:
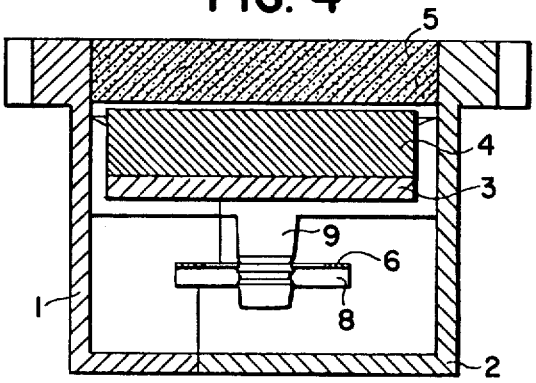
FIG. 4 is a back sectional view of the embodiment of FIG. 1 taken along the line IV—IV.

When the body 5 is cold the magnet 4 is held attracted against it so that the magnet holder 3 takes the position shown with full lines in FIG. 2. The snap spring 10 acts against the force of attraction by tending, by means of its bias between the contact tongue 6 and the pin 9 acting as a lever, to pivot the magnet holder 3 about the pivot axis 13. Due to the fact that the point of bias of the snap spring 10 at the pin 9 lies above the plane of the contact tongue 6, when the magnet is attracted, the spring 10 also acts in the contact making direction, i.e. the contact tongue 6 is pressed against the contact spot of the terminal tag 7 within the housing 1, 2.

Upon heating of the sensing plate 5 its magnetic properties deteriorate so that the force of attraction is reduced and at last is overcome by the force of the spring 10 acting about the axis 13 via the lever 9. When the magnet holder 3 thereby is pivoted clockwise in FIG. 2 about the axis 13 the point of bias of the spring 10 at the pin 9 will simultaneously pass the plane of the contact tongue 6. Thereby the snap spring 10 will suddenly pass over the act the contact opening direction on the contact tongue 6. The positions of the magnet holder 23 and of the contact tongue 6 then are shown with broken lines in FIG. 2. It will be seen that the contact tongue 6 is pressed against the underside of projection 14 against the upper side of which the magnet holder 3 is simultaneously pressed.

The dimensioning can preferably be such that contact opening appears already at a temperature level below the Curie point. As soon as the temperature of the sensing body 5, when cooling, passes this temperature level the magnet 4 is again attracted against the armature 5 with contact being made as a consequence.

From the above description it is noted that the snap spring 10 has a threefold function, i.e. it secures a safe and reliable contact and a distinct transition between the two positions of the contact tongue, it exerts the counter force to the attraction force on the magnet, and finally it insured that the magnet holder is kept pivotally journalled without need for further mounting means, such as hinges or the like. By means of the multiple function of the snap spring a number of otherwise necessary structure details are eliminated, this simplifying the structure and allowing a reliable and compact design.

I claim:

1. A thermostat comprising:

a housing;

a heat sensitive body made of ferromagnetic material connected to said housing, said body losing magnetic attraction with a change in temperature;

magnet means having a magnet movably mounted to said housing from an attracted position toward said body to a spaced position away from said body, said magnet means including an outwardly extending lever element;

a fixed contact connected to said housing;

a movable contact mounted to said housing having a contact portion movable from a first position in contact with said fixed contact to a second position spaced from said fixed contact; and biasing means connected between said movable contact and said lever element for biasing said magnet means into its spaced position and simultaneously biasing said movable contact into its second position, said biasing means connected for moving said movable contact into its second position with said magnet means in its spaced position, and for moving said movable contact into its first position with said magnet means in its attracted position.

2. A thermostat according to claim 1, wherein said magnet means comprises a magnet holder having an opened recess, said magnet positioned in said opened recess and having an exposed surface facing said heat sensitive body, said holder pivotally journalled about an axis in said housing, said movable contact comprising a contact tongue lying substantially in a plane, said axis extending transversely to said plane.

3. A thermostat according to claim 2, wherein said tongue includes an opening therein, said lever element extending through said opening.

4. A thermostat according to claim 3, wherein said biasing means comprises a biasing snap spring connected to said tongue from an edge of said opening and engaged with said lever element.

5. A thermostat according to claim 1, wherein said housing includes a wall formed substantially by said heat sensitive body, said wall including a support spot, said magnet means pivotally journalled at said support spot for pivotal movement in said housing, said magnet means comprising a plate-shaped magnet holder extending across an interior of said wall, a side of said holder facing away from said wall carrying said lever element.

6. A thermostat according to claim 5, wherein said support spot comprises a straight inner edge at a boundary of said inner wall and another wall of said housing, said holder having a straight support edge pivotally journalled against said straight inner edge and at a corner thereof having an angle which is more acute than an angle between said first mentioned and other wall, said biasing means biasing said holder into engagement with said straight inner edge.

7. A thermostat according to claim 6, wherein said housing includes a projection on an inner surface thereof opposite said straight inner edge, said projection forming an abutment for said holder in its spaced position and said movable contact in its second position.

8. A thermostat according to claim 7, wherein said biasing means comprises a curved leaf spring extending from said movable contact toward and into engagement with said lever element.

9. A thermostat according to claim 8, wherein said movable contact comprises a contact tongue having an opening therein, said spring extending from an edge of said opening to said lever element and said lever element extending through said opening.

* * * * *